US006978920B2

(12) United States Patent
Hamada et al.

(10) Patent No.: US 6,978,920 B2
(45) Date of Patent: Dec. 27, 2005

(54) BOX NAILING MACHINE

(75) Inventors: Masao Hamada, Ibaraki (JP); Akira Oono, Ibaraki (JP); Hiroshi Okazaki, Ibaraki (JP); Toshiaki Kishino, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/697,009

(22) Filed: Oct. 31, 2003

(65) Prior Publication Data

US 2004/0112934 A1 Jun. 17, 2004

(30) Foreign Application Priority Data

Nov. 1, 2002 (JP) ..... P. 2002-319951
Jul. 2, 2003 (JP) ..... P. 2003-190544

(51) Int. Cl.[7] ..... B25C 7/00
(52) U.S. Cl. ..... 227/120; 227/109; 227/130; 227/135
(58) Field of Search ..... 227/120, 109, 227/123, 130, 134, 135; 206/340, 341

(56) References Cited

U.S. PATENT DOCUMENTS 3,615,049 A * 10/1971 Obergfell et al. ..... 227/28
3,858,781 A * 1/1975 Obergfell et al. ..... 227/8
3,946,927 A * 3/1976 Fehrs ..... 227/126
4,801,062 A * 1/1989 Austin ..... 227/128
4,903,880 A * 2/1990 Austin et al. ..... 227/8
5,180,091 A * 1/1993 Ota ..... 227/8
5,588,577 A * 12/1996 Chen ..... 227/120
5,727,726 A * 3/1998 Lin ..... 227/119
6,056,181 A * 5/2000 Chuang ..... 227/8

FOREIGN PATENT DOCUMENTS

JP 2002-273669 9/2002

* cited by examiner

*Primary Examiner*—Louis K. Huynh
*Assistant Examiner*—Nathaniel Chukwurah
(74) *Attorney, Agent, or Firm*—McGinn IP Law Group, PLLC

(57) ABSTRACT

A box nailing machine includes: a box nailing machine body having a nail driving port from which nails are driven; a handle portion having a handle arm; and a magazine for accommodating nails in it, the forward end portion of which is attached to the nail driving port, the portion of the magazine except for the forward end portion being attached to the handle portion via the handle arm. The magazine has a handle arm attaching portion for attaching the magazine to the handle arm. The magazine is made of metal and formed substantially U-shape by press forming. A washer is integrally formed in the handle arm attaching portion so that the washer is disposed between a head portion of a fixing bolt and the magazine.

11 Claims, 9 Drawing Sheets

BOX NAILING MACHINE

BACKGROUND OF THE INVENTION

1. Field of the Invention

The present invention relates to a box nailing machine used for driving connected nails.

2. Background Art

In a box nailing machine in which connected nails extending in the longitudinal direction in a straight line are used, a magazine into which nails are charged is made by means of extrusion molding of aluminum, and a forward end portion of the magazine is fixed to a driving port from which nails are driven and a portion except for the forward end portion is fixed to a handle through an attaching arm. This structure is disclosed, for example, in JP-A-2002-273669. However, in order to manufacture the magazine at a low cost, it is considered to manufacture the magazine by means of press forming a metallic plate such as a steel plate. A box nailing machine having a magazine, which is press-formed in this way, is shown in FIGS. 1 to 4.

As described above, when the magazine 5 is attached to the handle portion 3, it is attached through the handle arm 4. As a method of attaching the magazine 5, which has been formed by means of press forming, to the handle arm 4, there are provided the following methods.

(1) Method of fixing by welding or calking as shown in FIGS. 1 and 2.

(2) Method of fixing by means of bolts as shown in FIGS. 3 and 4.

However, in the case of item (1) in which fixing is executed by welding or the like, the following problems maybe encountered. When the box nailing machine is used over a long period of time, there is a possibility that the handle arm 4 is broken by a shock given in the case of driving nails. In the case of repairing the broken handle arm 4, since the handle arm 4 and the magazine 5 are welded to each other, the handle arm 4 must be replaced together with the magazine 5, which increases the repairing cost. In the case of item (2) in which the magazine 5 is fixed by bolts 7, the following problems may be encountered. Although it is common that the washer 9 is interposed between the bolt 7 and the attaching portion of the magazine 5 so that the magazine 5 can be fixed, in the case of a box nailing machine having a large magazine 5, the magazine 5 is fixed to the handle arm 4 by a plurality of bolts 7 for supporting the magazine 5. Therefore, when a plurality of washers 9 necessary for the plurality of bolts 7 are used as shown in FIGS. 5 and 6, the assembling efficiency is deteriorated. Therefore, it is considered to use one plate 10 as shown in FIG. 7. However, in order to insert the plate 10 into the magazine 5 in the process of assembling the magazine 5 to the handle arm 4, it is necessary to form a hole 13 for inserting the plate 10 into the magazine 5. The size of the hole 13, into which the plate 10 can be inserted, is so large that the mechanical strength of the magazine 5, which is formed by press forming a metallic plate such as a steel plate, is lowered.

SUMMARY OF THE INVENTION

It is an object of the present invention to provide a box nailing machine characterized in that: a magazine, which is formed by press forming a metallic plate, and a handle arm can be fixed to each other by not welding but by fastening bolts; and the assembling property of assembling the box nailing machine and the magazine to each other is enhanced without deteriorating the mechanical strength.

To achieve the object, the invention provides a box nailing machine including: a box nailing machine body having a nail driving port from which nails are driven; a handle portion having a handle arm; and a magazine for accommodating nails in it, the forward end portion of which is attached to the nail driving port, the portion of the magazine except for the forward end portion being attached to the handle portion via the handle arm; wherein the magazine has a handle arm attaching portion for attaching the magazine to the handle arm; the magazine is made of metal and formed substantially U-shape by press forming; and a washer is integrally formed in the handle arm attaching portion so that the washer is disposed between a head portion of a fixing bolt and the magazine.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
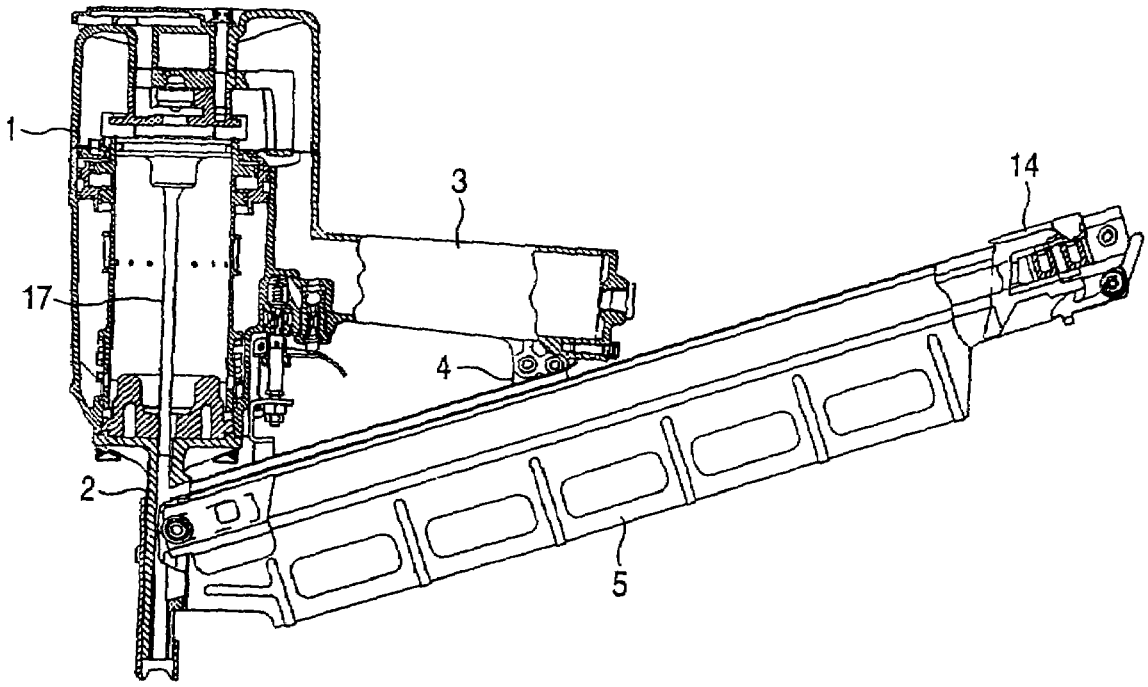
FIG. 1 PRIOR ART
FIG. 1 is a partially sectional front view of a conventional box nailing machine.
Figure 2:
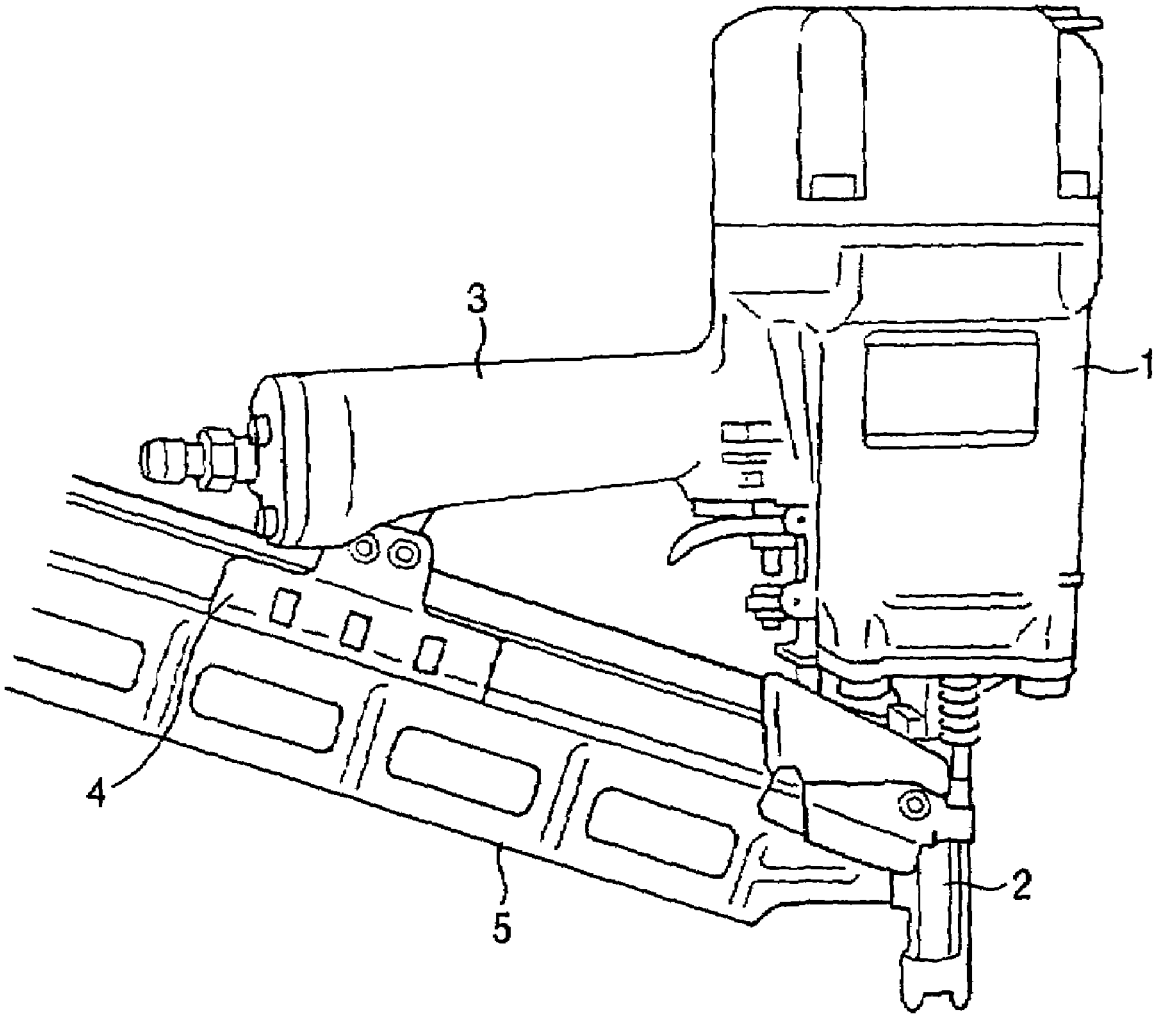
FIG. 2 PRIOR ART
FIG. 2 is a rear view of FIG. 1.
Figure 3:
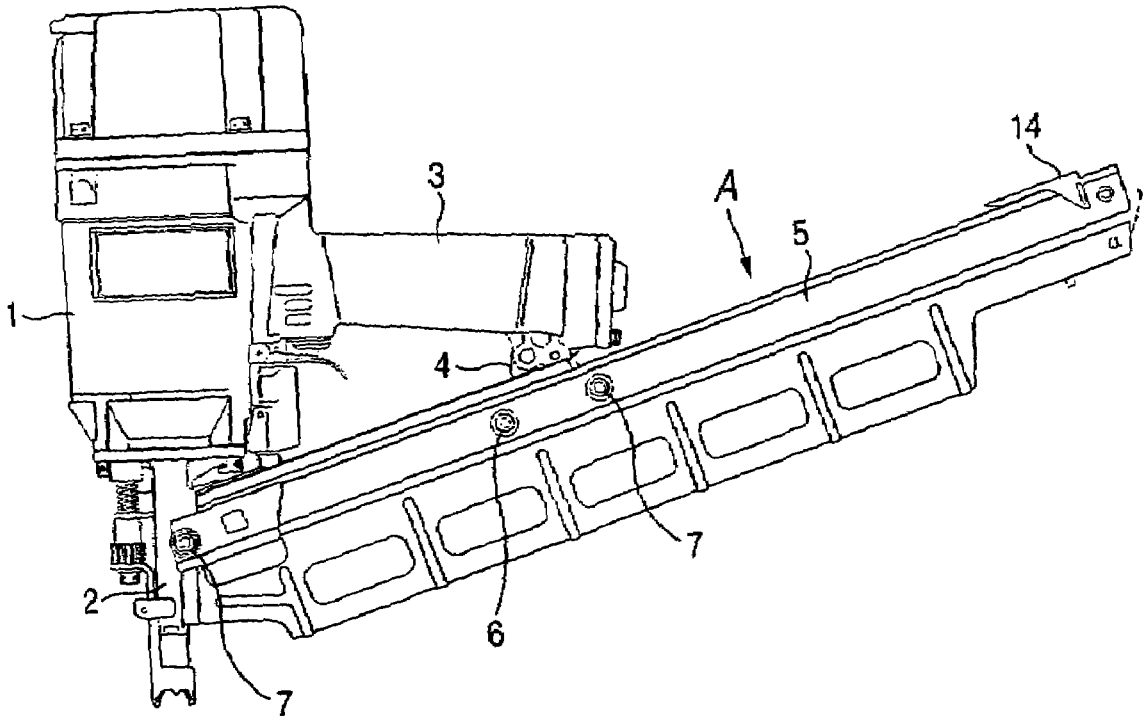
FIG. 3 PRIOR ART
FIG. 3 is a partially sectional front view of another conventional box nailing machine.
Figure 4:
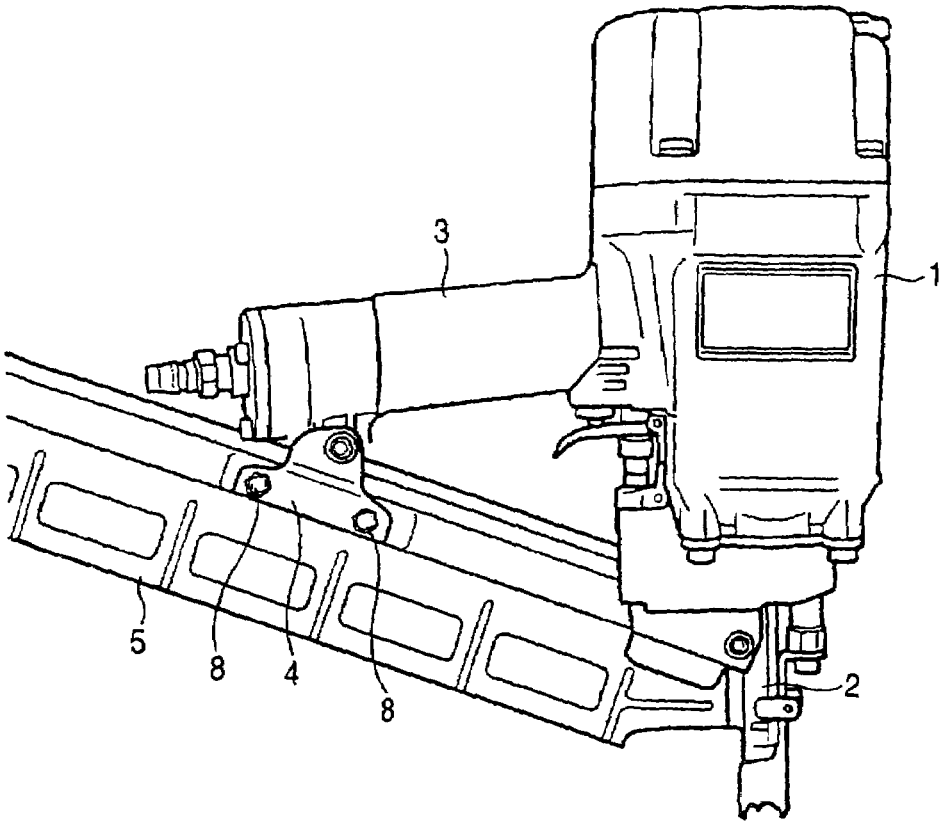
FIG. 4 PRIOR ART
FIG. 4 is a rear view of FIG. 3.
Figure 5:
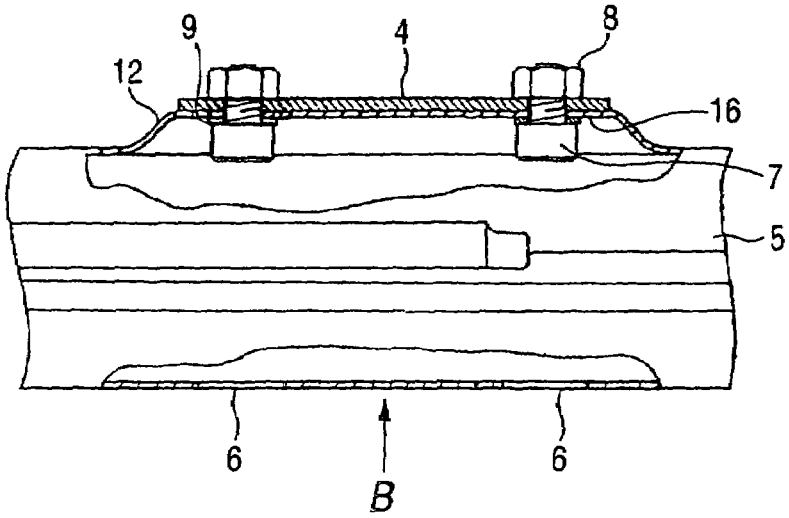
FIG. 5 PRIOR ART
FIG. 5 is a partially sectional view taken in the direction of A in FIG. 3.
Figure 6:
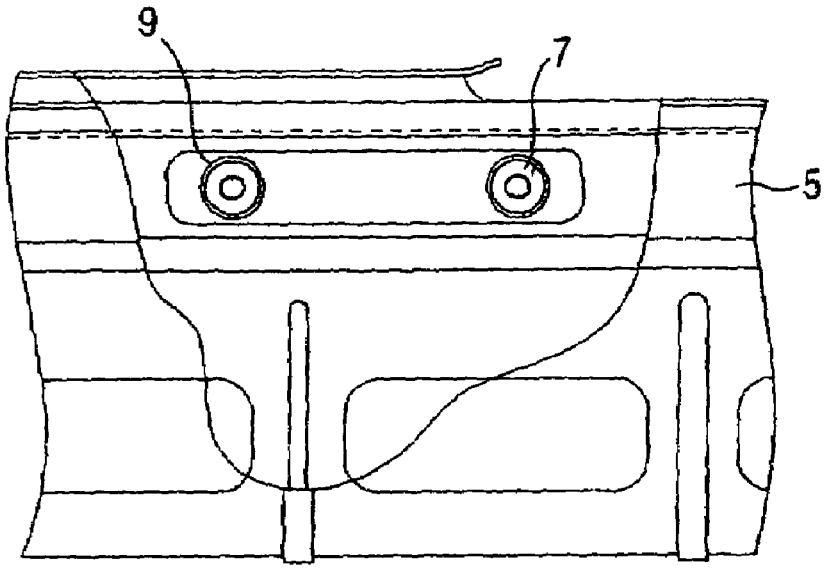
FIG. 6 PRIOR ART
FIG. 6 is a partially sectional view taken in the direction of B in FIG. 5.
Figure 7:
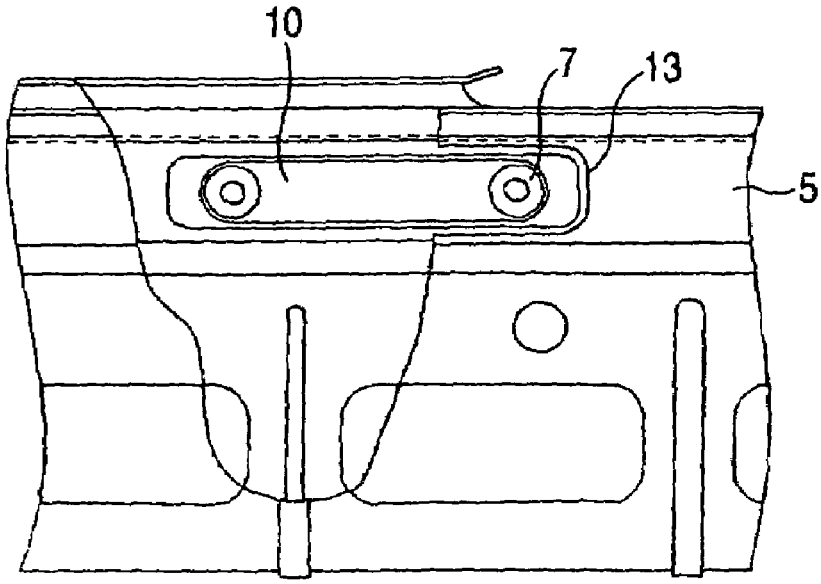
FIG. 7 is a view corresponding to FIG. 6 showing another example of attaching a magazine.

Referring to the drawings, an embodiment of the present invention will be explained below.

Figure 8:
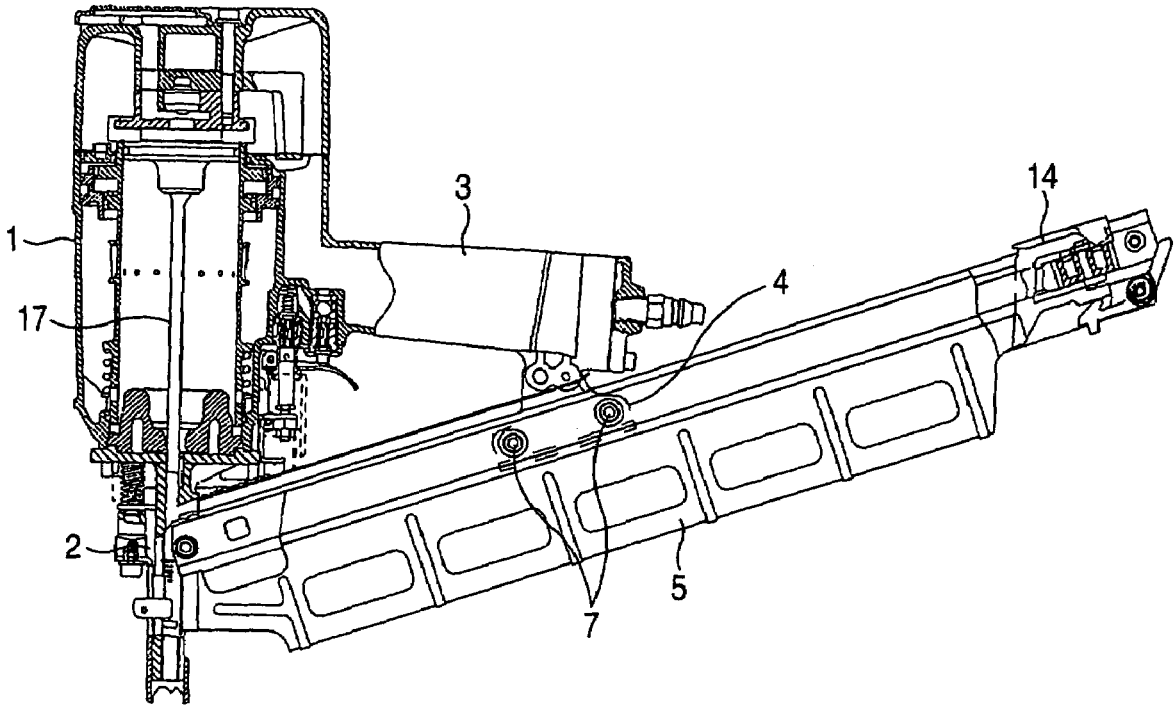
FIG. 8 is a partially sectional front view showing an embodiment of the box nailing machine of the present invention.
Figure 9:
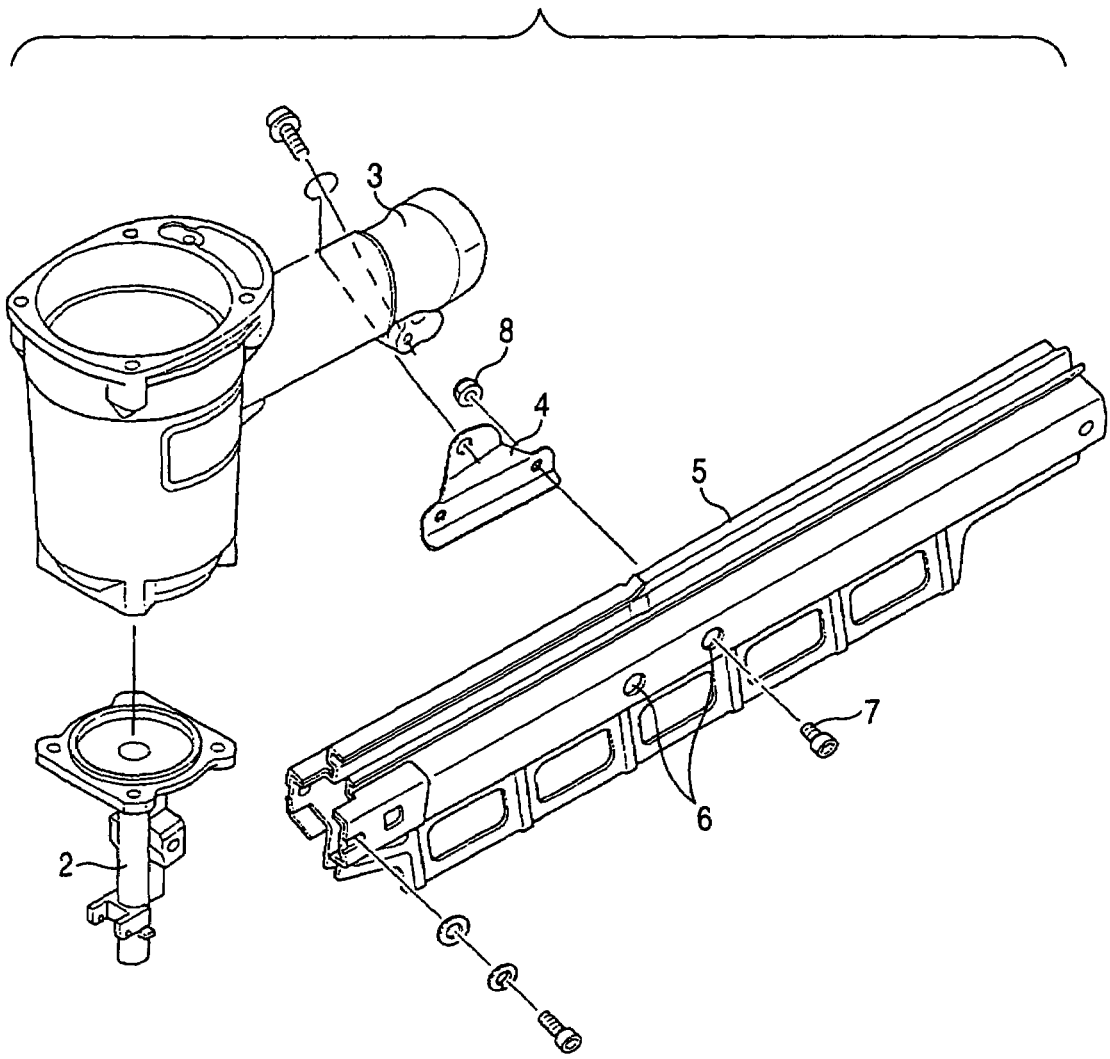
FIG. 9 is a perspective development view of FIG. 8.

As shown in FIG. 8, the box nailing machine includes: a box nailing machine body 1 having a piston 17 for driving a nail when it is reciprocated by compressed air and also having a driving port 2 in which a nail to be driven passes through; a handle 3 integrated with the box nailing machine body 1 into one body; and a magazine 5, the forward end portion of which is connected to the nail driving port 2, a portion of the magazine 5 except for the forward end portion being fixed to the handle arm 4 attached to the handle 3, the magazine 5 accommodating nails to be driven. The magazine 5 is provided with a feeder 14 for pushing the accommodated nails toward the nail driving port 2.

Figure 10:
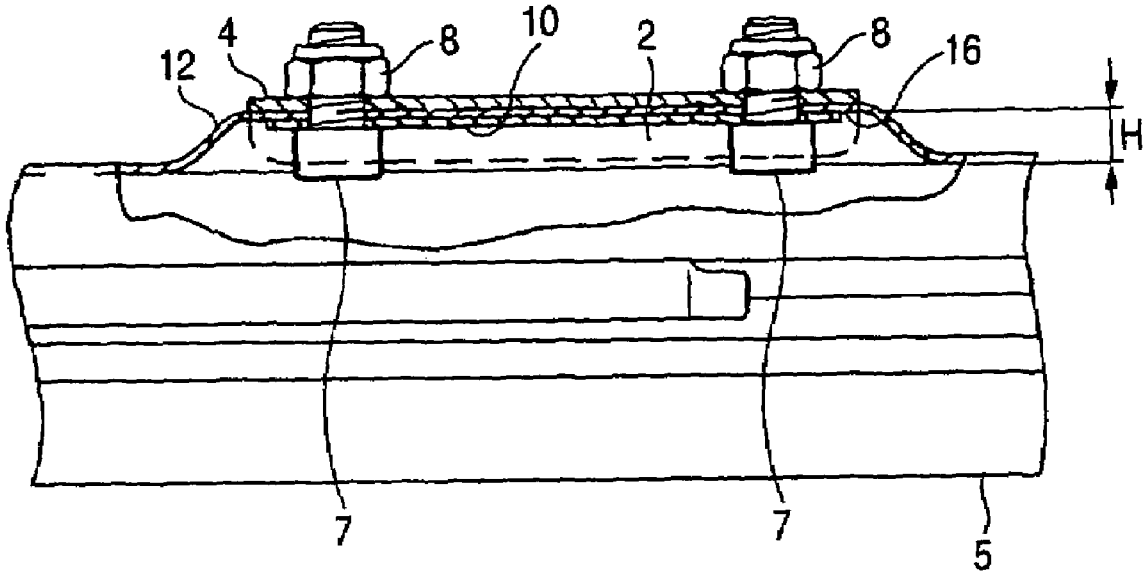
FIG. 10 is a view showing the structure shown in FIG. 8 corresponding to FIG. 5.
Figure 11:
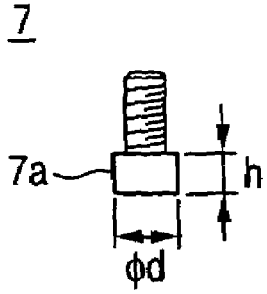
FIG. 11 is a front view showing a bolt.
Figure 12:
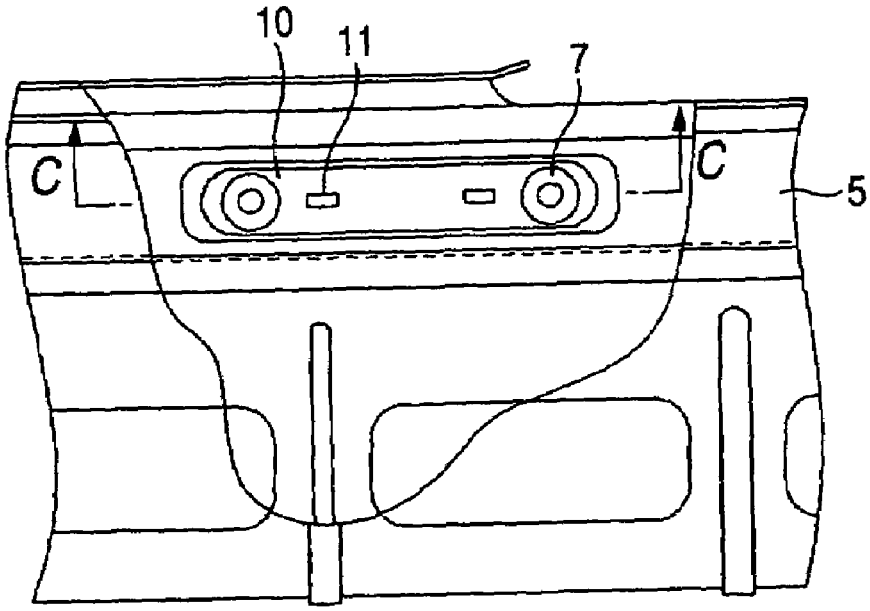
FIG. 12 is a view showing the structure shown in FIG. 8 corresponding to FIG. 6.

The magazine 5 is formed in such a manner that a metallic plate such as a steel plate is press-formed into a substantial U-shape in which an upper portion in the nail driving direction is open, that is, an upper side in FIG. 8 is open. As shown in FIG. 10, the handle arm attaching portion 12 of the magazine 5 is protruded outside toward arm 4, and the plate 10 as a washer of the present invention is fixed to the magazine 5 inner wall face of the handle arm attaching portion 12 by means of calking, so that the plate 10 is integrated with the magazine 5 into one body. In this case, it is preferable that the relation between size H of the handle arm attaching portion 12 shown in FIG. 10, that is, the depth of the magazine protruding portion and height h of the bolt head 7*a* is H≧h so that the feeder 14, which pushes and feeds the connected nails to the driving port, and the connected nails can smoothly pass through in the magazine.

Figure 13:
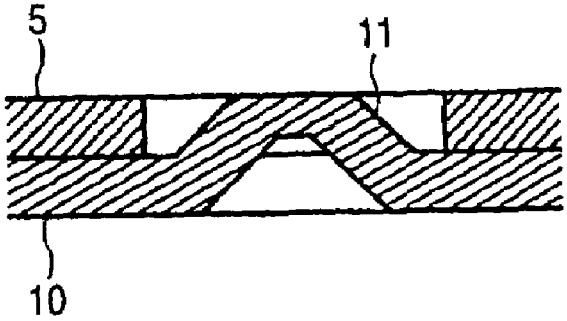
FIG. 13 is a sectional view taken on line C—C in FIG. 12.

In this embodiment, the plate 10 is fixed to the magazine 5 and the magazine 5 is formed as follows:

(1) press-forming the handle arm attaching portion 12 of the magazine 5 by drawing;

(2) setting the plate 10 in the attaching portion 12 and calking the plate with the V notch 11 shown in FIG. 13 so that the plate 10 is fixed to and integrated with the magazine 5;

(3) press-forming the U-shaped magazine 5.

In this connection, the following procedure may be adopted. The plate 10 is fixed to the magazine 5 in the middle of press forming the magazine 5. Concerning the method of fixing the plate 10 to the magazine 5, welding such as projection welding, soldering or adhering, in which adhesive is used, may be adopted.

The magazine 5 and the handle arm 4 are assembled to each other as follows. The bolt 7 for fixing the magazine 5 to the handle arm 4 is inserted into the magazine 5 from the opening portion 6, which is previously formed on one side of the magazine 5, the diameter of which is larger than the head diameter ϕd of the bolt 7. The bolt 7 is inserted into the through-hole, which is open on the protruding portion bottom face 16 substantially opposed to the opening portion 6, from the magazine 5 side, and the bolt 7 is fastened by the nut 8 on the opposite side so as to fix the bolt 7. In this connection, a screw may be used instead of the bolt 7 for fixing the magazine 5, because it is sufficient that the magazine 5 is fixed.

According to the present invention, instead of the conventional washer, the plate is fixed to the magazine by means of calking in the process of press forming the magazine. Due to the foregoing, it becomes unnecessary to provide a plate attaching hole in the magazine. Therefore, it is possible to enhance the assembling property of assembling the box nailing machine and the magazine without lowering the mechanical strength of the magazine.

What is claimed is:

1. A box nailing machine comprising:

a box nailing machine body comprising a nail driving port from which nails are driven;

a handle portion comprising a handle arm; and a magazine for accommodating nails, a forward end portion of which is attached to the nail driving port, a portion of the magazine except for the forward end portion being attached to the handle portion via the handle arm;

wherein the magazine comprises a handle arm attaching portion for attaching the magazine to the handle arm;

the magazine comprises metal and is formed substantially into a U-shape by press forming; and a plate integrally formed in the handle arm attaching portion so that the plate is disposed between a head portion of a fixing bolt and the magazine, wherein the plate is fixed to the handle arm attaching portion by at least one of caulking, welding, soldering, and adhering.

2. The box nailing machine according to claim 1, wherein the handle arm attaching portion protrudes toward the handle arm; and the magazine comprises an opening portion larger than an outer dimension of the fixing bolt at a position opposed to the handle arm attaching portion.

3. The box nailing machine according to claim 2, wherein the protruding size of the handle arm attaching portion is one of equal to and larger than the height of a head portion of the fixing bolt.

4. A box nailing machine comprising:

a body comprising a nail driving port;

a handle portion attached to the body and comprising a handle arm; and a U-shaped magazine comprising:

a forward end attached to the nail driving port;

a handle arm attaching part attached to the handle arm; and a plate fixed to an inner wall of the handle arm attaching part, wherein the plate is fixed to the inner wall by at least one of caulking, welding, soldering, and adhering.

5. The box nailing machine of claim 4, wherein the plate comprises a press-formed metal plate.

6. The box nailing machine of claim 4, wherein the handle arm attaching part protrudes toward the handle arm.

7. The box nailing machine of claim 6, further comprising a fastener attaching the U-shaped magazine to the handle arm and wherein the handle arm attaching portion protrudes toward the handle arm by a distance larger than the height of the head of the fastener.

8. The box nailing machine of claim 4, wherein the U-shaped magazine is attached to the handle arm with a fastener.

9. The box nailing machine of claim 8, wherein the fastener comprises one of a screw and a bolt.

10. The box nailing machine of claim 8, wherein the U-shaped magazine comprises an opening opposed to the handle arm attaching part and larger than the head of the fastener.

11. The box nailing machine of claim 4, wherein the U-shaped magazine comprises a slot that receives a V-shaped notch in the plate.

* * * * *